US008151983B2

(12) United States Patent
King, Jr. et al.

(10) Patent No.: US 8,151,983 B2
(45) Date of Patent: Apr. 10, 2012

(54) PRODUCT DISPLAY CONTAINER

(75) Inventors: L. Herbert King, Jr., Jupiter, FL (US); Steven Rhea, St. Peters, MO (US)

(73) Assignee: The Patent Store LLC, O'Fallon, MO (US)

( * ) Notice: Subject to any disclaimer, the term of this patent is extended or adjusted under 35 U.S.C. 154(b) by 0 days.

(21) Appl. No.: 12/657,043

(22) Filed: Jan. 13, 2010

(65) Prior Publication Data

US 2011/0168580 A1 Jul. 14, 2011

(51) Int. Cl.
*B65D 77/00* (2006.01)

(52) U.S. Cl. ..... 206/216; 215/390

(58) Field of Classification Search ..... 206/216, 206/223, 408, 102, 288, 291, 289, 427, 428, 206/430, 431, 433, 436, 10, 535, 537, 538; 220/4.26, 23.83, 23.89, 23.4, 743, 751; 215/6, 215/399, 390, 398, 382–384, 10
See application file for complete search history.

(56) References Cited

U.S. PATENT DOCUMENTS

| | | | | | |
|---|---|---|---|---|---|
| D277,552 | S | * | 2/1985 | Kung | D9/524 |
| 4,548,339 | A | * | 10/1985 | Gorman | 222/129 |
| 4,592,478 | A | * | 6/1986 | Laconis | 220/23.83 |
| D284,641 | S | * | 7/1986 | Jones | D9/524 |
| 4,823,947 | A | * | 4/1989 | Maynard, Jr. | 206/223 |
| D335,745 | S | * | 5/1993 | Schilthuizen | D34/39 |
| 5,305,910 | A | * | 4/1994 | Pollacco | 220/771 |
| 5,447,245 | A | * | 9/1995 | Merhar | 215/6 |
| D371,967 | S | * | 7/1996 | Miller | D9/520 |
| D373,532 | S | * | 9/1996 | Miller | D9/520 |
| 5,564,525 | A | * | 10/1996 | Dunnegan et al. | 184/1.5 |
| D454,789 | S | * | 3/2002 | Harvey et al. | D9/527 |
| 6,352,167 | B1 | * | 3/2002 | Yu | 220/522 |
| D470,054 | S | * | 2/2003 | Gerhart et al. | D9/524 |
| 6,631,744 | B1 | * | 10/2003 | Gerhart et al. | 141/22 |
| 7,140,135 | B2 | * | 11/2006 | Irvine et al. | 40/638 |
| 7,182,214 | B2 | * | 2/2007 | Darr et al. | 215/398 |
| D597,408 | S | * | 8/2009 | Chang | D9/524 |
| 2003/0132184 | A1 | * | 7/2003 | Dorn et al. | 215/10 |

OTHER PUBLICATIONS http://www.idealindustries.com/media/pdfs/catalog/p-070_full-line_catalog.pdf.*

* cited by examiner

*Primary Examiner* — Luan K Bui
*Assistant Examiner* — Rafael Ortiz
(74) *Attorney, Agent, or Firm* — Jackson & Johnson LLC

(57) ABSTRACT

A touch-and-feel product display container for holding a plurality of products within the container and at least one product external to the container wherein the product external to the container is retained on the outside of the container in a position where a perspective purchaser can touch-and-feel the product without having to remove either the product from an external product holder or one of the products from the compartment within the container.

9 Claims, 4 Drawing Sheets

PRODUCT DISPLAY CONTAINER

FIELD OF THE INVENTION

This invention relates generally to containers and, more specifically, to containers that allow a prospective purchaser to touch-and-feel the product without removing the product from the container.

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

Oftentimes products, which are sold in containers, have attributes that offer benefits and advantages that other similar products do not have. While an onsite description of the product discloses the benefits and advantages of the product a perspective customer may be somewhat reluctant to accept the merits of the description accompanying the product. This is particularly true with small items such as wire connectors, which are sold in containers that are either sealed or unsealed. To determine if the claims of the product benefits are true a customer may open the package and remove a product from a container to determine if the product does really offer the claimed benefits and advantages. Subsequent customers may be reluctant to purchase the container with the products if the container has been opened. In addition if different products are removed they may not be placed back into the correct container. The invention described herein allows a user to experience the touch-and-feel of a product without having to remove one of the products from the container.

SUMMARY OF THE INVENTION

A touch-and-feel product display container for holding a plurality of products within the container and at least one product external to the container wherein the product external to the container is retained on the outside of the container in a position where a perspective purchaser can experience the touch-and-feel of the product without having to remove either the product from an external product holder or one of the products from the compartment within the container.

DESCRIPTION OF THE PREFERRED EMBODIMENT

Figure 1:
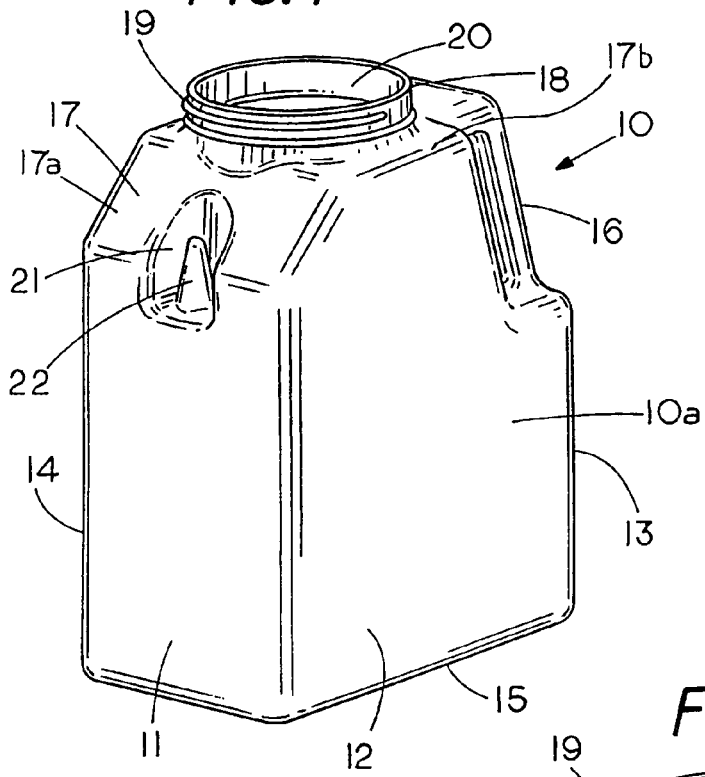
FIG. 1 is a perspective view of a product display container.
Figure 2:
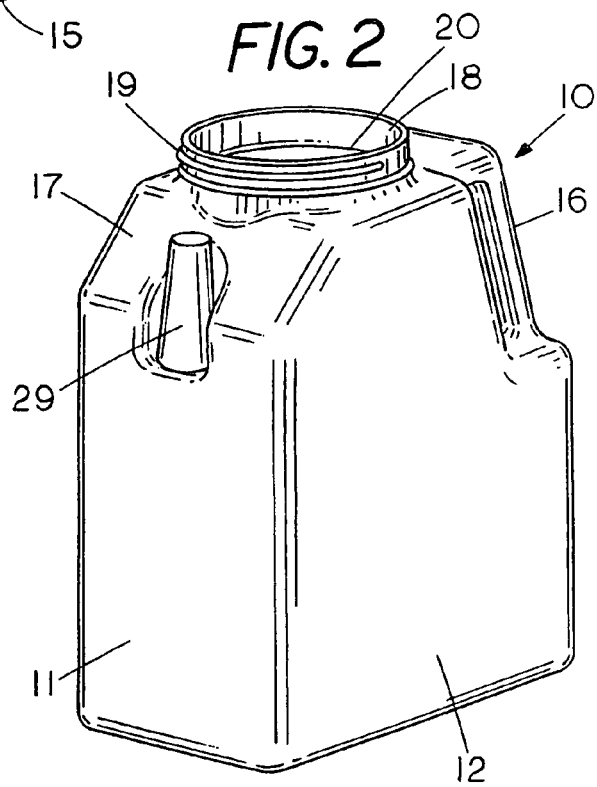
FIG. 2 is a perspective view of a product display container of FIG. 1 supporting a product in a touch-and-feel condition.

FIG. 1 shows a perspective view of a one-piece touch-and-feel product display container 10 without a product being displayed and FIG. 2 shows the product display container 10 with a product 29 in a touch-and-feel display condition external to the container 10. The container 10 includes a continuous sidewall 10*a* formed by a set of rigid flat panels 11, 12, 13, 14, a top member 17 and a bottom member 15 which together form an internal product compartment 20 for holding a plurality of products in a storage or transportable condition. While sidewall 10*a* is shown formed from a set of four rigid flat panels, sidewall 10*a* may have other, shapes for example, cylindrical, oval or spherical as well as flexible or semi-flexible. In the example shown the sidewall comprises a transparent material so that products contained within the compartment 20 can be viewed but not touched by a prospective purchaser. While sidewall 10*a* may be transparent no limitation is intended thereto as the container 10 may be made from other materials that prevent viewing of the products in the compartment without departing from the sprit and scope of the invention. Container 10 may be formed by molding or the like although no limitation is intended thereto.

Figure 5:
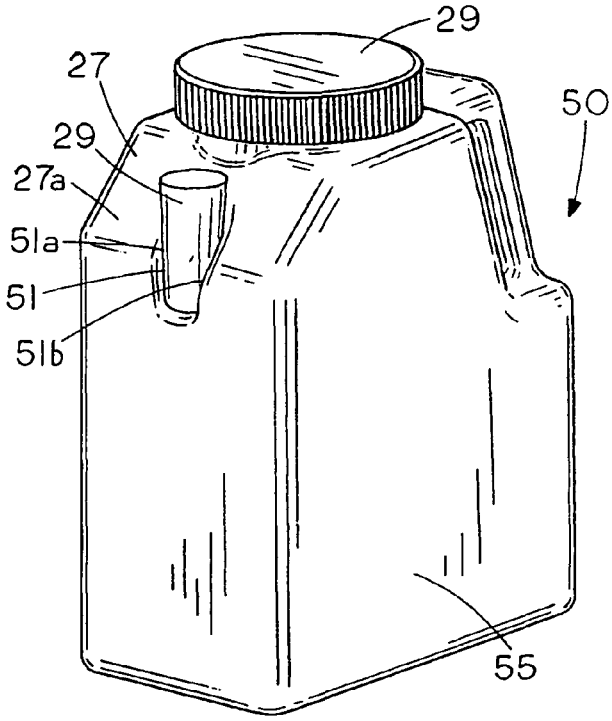
FIG. 5 is a perspective view of another example of a product display container.

FIG. 1 and FIG. 2 show container 10 includes a handle 16 integrally formed in sidewall 10*a* to facilitate handling of the product display container 10 and a top member 17 to allow access to compartment 20. The top member 17 includes a neck 18, which protrudes upward from top member 17, with neck 18 including a male thread 19 for rotational engagement and disengagement with a female thread in a cover that is securable to container 10 to permit access to products contained in compartment 20. FIG. 5 shows an example of a typical cover 39 having a female thread (not shown) for securing the cover 39 to neck 18 through rotational engagement with male thread 19. In the example shown a portion 17*a* of top member 17 is located at an acute angle to panel 11 and a further portion 17*b* of top member 17 is located in a parallel condition from bottom member 15. Although top member 17*a* is shown extending at an acute angle from sidewall 10*a* top member 17*a* may be an upward continuation of the panel 11 without departing from the spirit and scope of the invention.

Located in sidewall 10*a* is an external product holder 22, comprising a hollow frusto conical post which is integral to the sidewall 10*a*. Product holder 22 is operable for frictionally retaining a product in a position whereby the product can be touched and felt without removing the product from the external product holder 22 thereby permitting a prospective customer to touch-and-feel the exterior surface of an actual product without having to remove the product from the external product holder 22.

Figure 3:
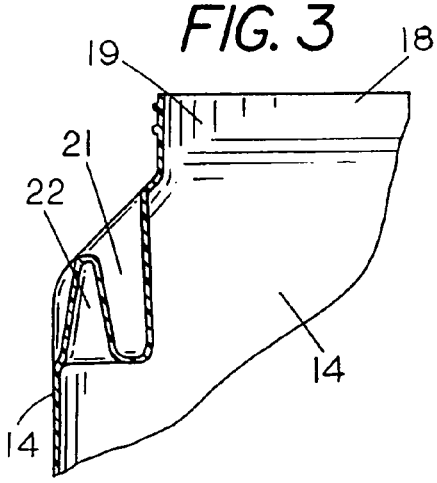
FIG. 3 is a partial view of a product pocket on the exterior of the product display container of FIG. 1.

FIG. 3 is a partial cutaway view of container 10 which shows the external product holder comprising a frusto conical post 22 which is located within pocket 21 and is integrally formed from sidewall 10*a*. Although post 22 is integrally formed from sidewall 10*a* it is envision that in some instances post 22 may be formed separately and then secured to the sidewall through adhesive or mechanical fasteners.

In the example of FIG. 1 the product holder 22, which is a frusto conical post, is located in a pocket 21 with the frusto-conical post integrally formed in sidewall 10*a* and positioned in pocket 21 so that a product secured thereto does not project laterally outward beyond a vertical plane extending through sidewall 10*a*. The purpose of having the product in a pocket or at least partially in a pocket is to prevent the product from extending laterally outward beyond a vertical plane extending through the sidewall 10*a* in order to facilitate shipping of the container with a product secured thereto as well as to prevent accidental dislodging of the product during handling of the container.

Figure 4:
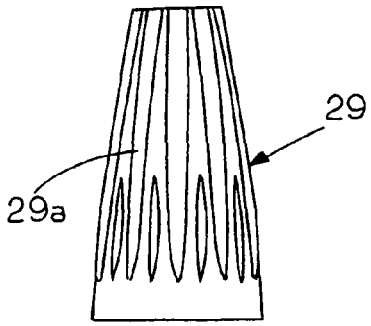
FIG. 4 is an example of a product that can be supported on the exterior of the of the product display container of FIG. 1.
Figure 4B:
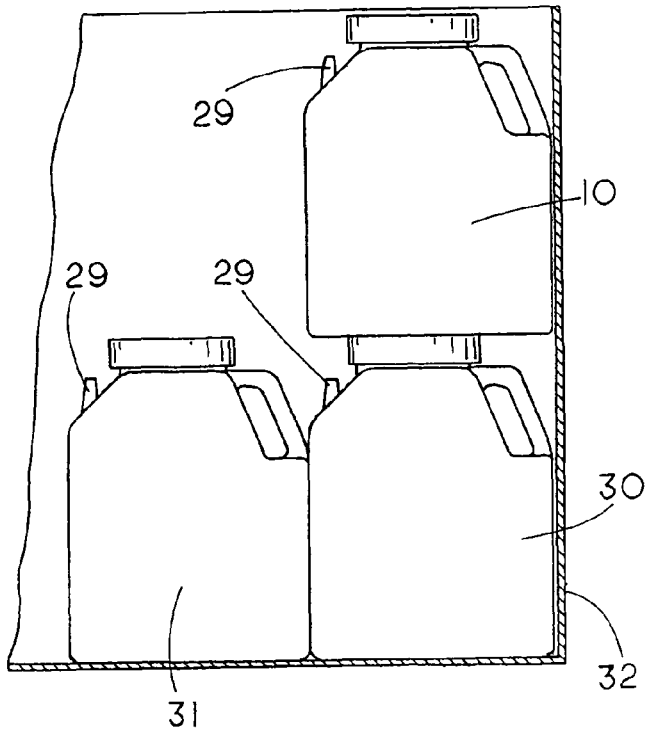
FIG. 4B shows a plurality of product display containers in a stacked condition.
Figure 4A:
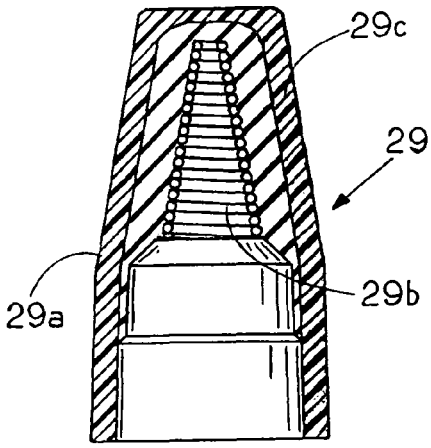
FIG. 4A shows a cross section view of the of FIG. 4.

FIG. 4 and FIG. 4A show a show a product, such as a twist-on wire connector 29, having an outer covering 29*c* with a surface 29*a* that would normally be grasped when a user applied the twist-on wire connector to a wire end. Since the touch-and-feel of the cushion grip of a twist-on wire connector may be significant to a user the placement of a twist-on wire connector in a touch-and-feel display position is an example of a product well suited for the display product holder shown and described herein. Located on the interior of twist-on wire connector 29 is a spiral coil 29*b* for engaging and securing wires therein. In the embodiment of FIG. 4 and FIG. 4A the spiral coil 29*b* of wire connector 29 can be frictionally secured to the frusto conical post as illustrated in FIG. 2. In this example the outer portion of twist-on wire connector extends out of pocket 22 to allow a prospective purchaser to grasp and thus touch-and-feel the exterior surface of a twist on wire connector. A further benefit is that the product held in the external product display can be removed and used just as the products contained in the compartment within the container 10.

FIG. 4B illustrates how a plurality of product display containers 10, 30, and 31 may be packaged in container 32 with each holding a product 29 thereon in a position where the product does not come into contact with an adjacent container. That is the post which holds 29 is set back from the sidewalls of the container as well as the top of the container so that when the product 29, such as a twist-on wire connector is located thereon, the set back is sufficient so that when identical containers are stacked for shipping the product 29 on the post does not come into contact with adjacent containers and become accidentally dislodged from the post. Such set back arrangement becomes advantageous for shipping and storing the product display containers prior to sale to an end user.

Referring to FIG. 1-4A post 22 may be the sole means for retaining the twist-on wire connector 29 in a display condition on the exterior of the container through frictional engagement between the threads of the spiral coil 29*b* and the exterior surface of post 22, which can be obtained by rotating the twist-on wire connector onto the post 22 much like one secures a nut to a bolt. However, if desired one may also enhance the retention forces on twist-on wire connector 29 by using the sides of pocket 22 to form a slight interference fit with the exterior surface of twist-on wire connector 10.

FIG. 5 shows an alternate embodiment of a display container 50 having a sidewall 55 and cover 39. Located in sidewall 55 is a pocket 51 that has a first side 51*a* and a second side 51*b* that form an interference fit and hence friction fit with the exterior surface of wire connector 29, which is shown with the open end up. In this embodiment the post is eliminated and the retention of the product may be obtained through the frictional engagement between connector 29 and pocket sides 51*a* and 51*b*, which are integral to the container sidewall and top member 27. In the example shown a portion of top member 27*a* and sidewall 55 form the pocket 51 for the product display holder, however, it is envisioned that the pocket 51 could also be formed in either top member 27 or sidewall 55 without departing from the spirit and scope of the invention. In the embodiment of FIG. 5 if the closed end is on top it offers a user benefit in that the entire closed end of the twist-on wire connector which is free of restraint by the external pocket holder may be touched and felt without removing the twist-on wire connector from the external product holder.

Figure 6:
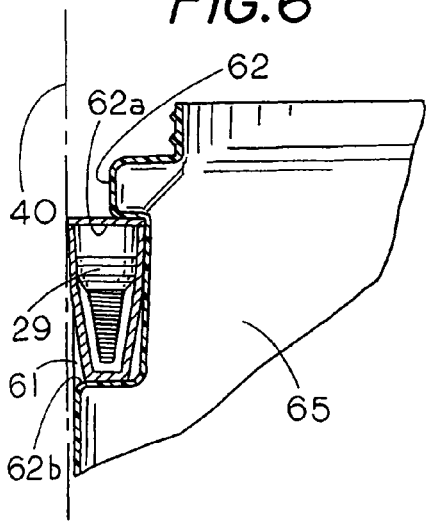
FIG. 6 shows a partial view of product being held in an external pocket in a product display container.
Figure 7:
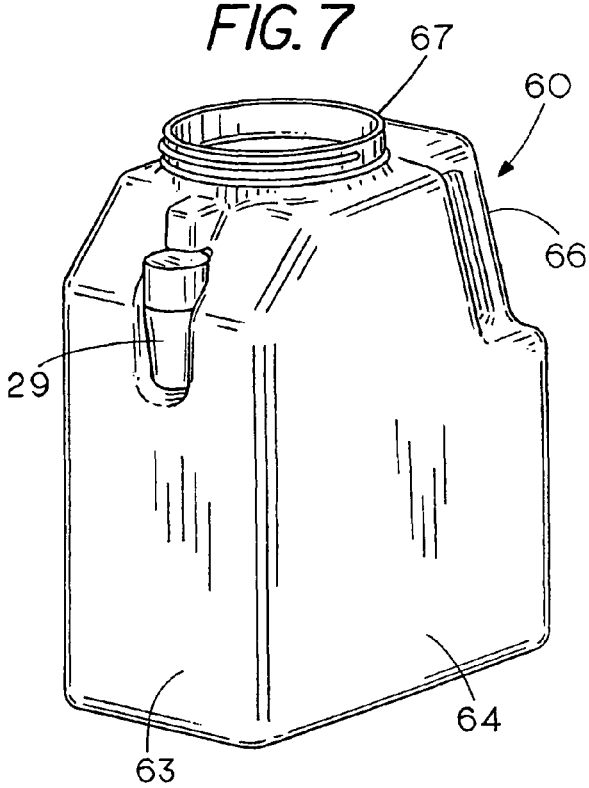
FIG. 7 shows is a perspective view of another example of a product display container.
Figure 8:
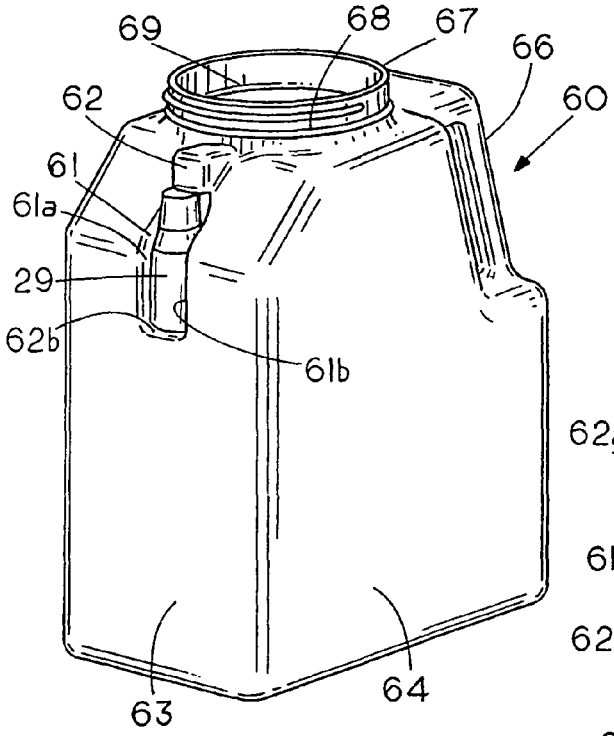
FIG. 8 shows is a perspective view of a product display container of FIG. 7 with the product held in a different orientation.
Figure 9:
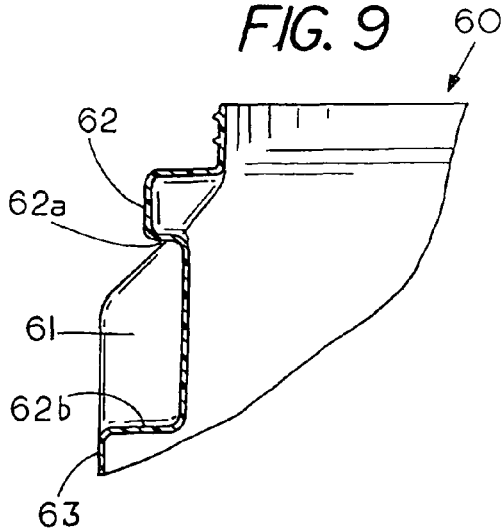
FIG. 9 shows the pocket of the product display container without a product therein.

FIG. 6 to FIG. 9 show another example of a touch-and-feel product display container with FIG. 7 showing a perspective view of display container 60 having an external product holder for holding a product such as a twist-on wire connector 29 in different orientation but also in a touch-and-feel condition. FIG. 9 is a partial cross sectional view showing pocket 61 having a bottom surface 62*b* and a post 62 extending outward over pocket 61 with post 62 having an under side 62*a*. In this example the cantilevered post 62 becomes the external product holder since the underside 62*a* of post can hold a twist-on product through frictional forces on the ends of a product. The lateral sidewalls 61*a* and 61*b* of the pocket 61 may also be used to laterally restrain movement of the product and if desired may also form a further frictional fit to better secure the product therein.

FIG. 6 shows a product such as a twist-on wire connector 29 secured in pocket 61 by the under side 62*a* of post 62 and the bottom surface 62*b* of pocket 61. In this embodiment the interference or frictional fit between the ends of the twist-on wire connector 29 retains the twist-on wire connector in a display condition even during the handling and transporting of the containers. In the example of FIG. 6 the post 62 becomes the external product holder, which is shown as integral to the sidewall of the container.

FIG. 6 and FIG. 7 show how twist-on wire connector 29 may be frictional held in a touch-and-feel display position with the open end up and FIG. 8 illustrates how twist-on wire connector may be frictionally held in a touch-and-feel position with the closed end down.

FIG. 9 shows a partial sectional view of container 60 to reveal the pocket 61 without a twist-on wire connector therein. As noted the bottom surface 62*b* and underside 62*a* of post 62 can coact to hold the twist-on wire connector in a position where the exterior of the twist-on connector can be touched and felt by a prospective customer.

Figure 10:
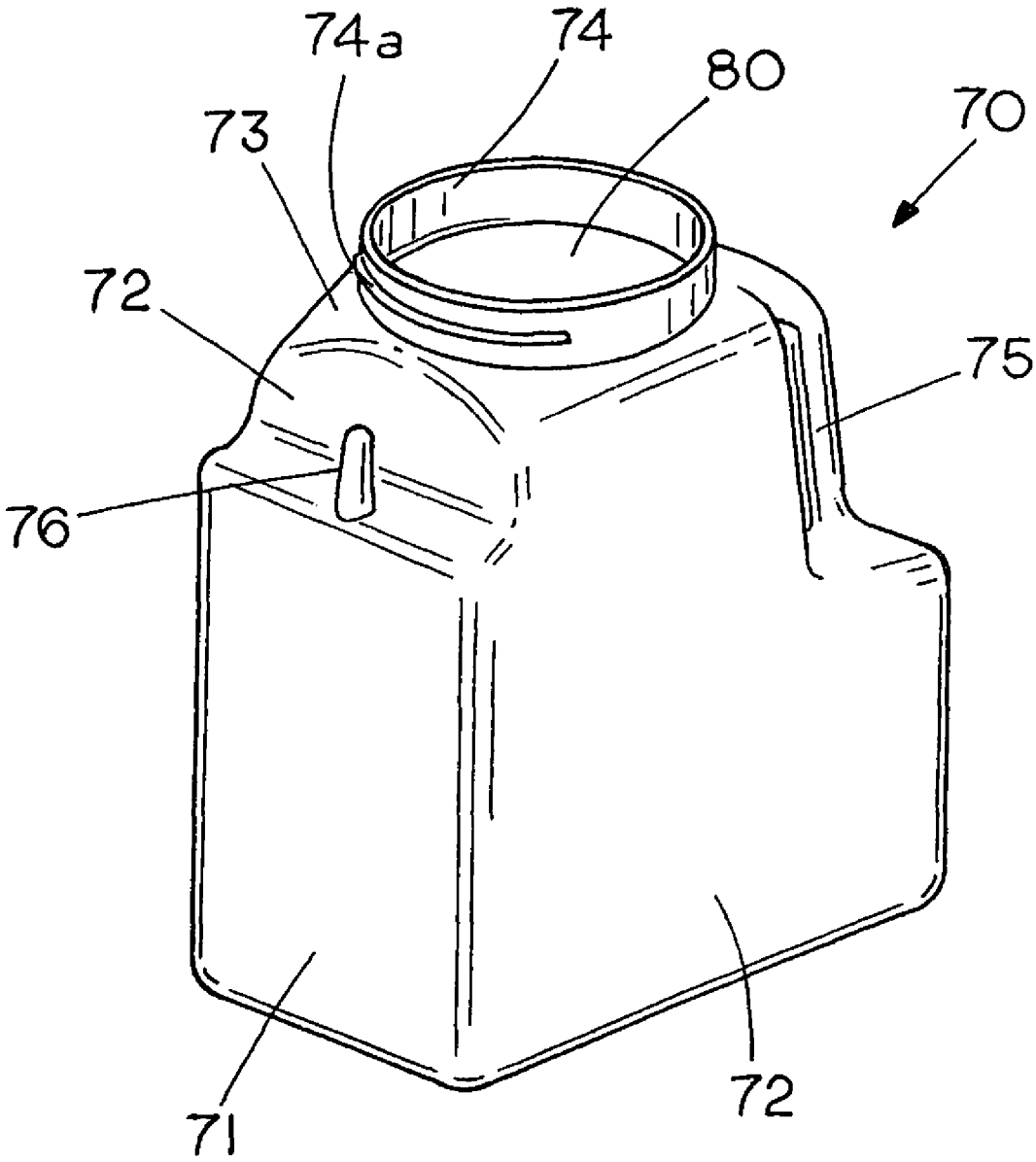
FIG. 10 shows is a perspective view of another example of a product display container.

FIG. 10 shows a perspective view of a container 70 to reveal a frusto conical post 76 without a twist-on wire connector thereon. Container 70 includes a handle 75 integrally formed in sidewall 10*a* to facilitate handling of the product display container 10 and a top member 73 to allow access to a compartment in container 70. The top member 73 includes a neck 74, which protrudes upward from top member 73, with neck 74 including a male thread 74*a* for rotational engagement and disengagement with a female thread in a cover that is securable to container 70 to permit access to products contained in a compartment 80. In the example shown a sidewall portion 72 of top member 73 extends downward and outward. Located in sidewall portion 72 is an external product holder 76, comprising a frusto conical post which is integral to the sidewall portion 72.

Product holder 76 is operable for frictionally retaining a product such as a twist-on-wire connector in a position whereby the product can be touched and felt without removing the product from the external product holder 22 thereby permitting a prospective customer to touch-and-feel the exterior surface of an actual product without having to remove the product from the external product holder 22. However, if desired the twist-on wire connector may be removed from post 76 by rotating the twist-on wire connector in a direction opposite to the direction that the twist-on wire connector was secured to post 76.

An advantage of the post product holder is that the external product surface need not be disturbed when fastening a product to the container since the internal surface of the product forms the physical engagement with the post product holder. Consequently, the outward appearance of the product secured thereon is not defaced or obscured by the post.

While the containers shown herein contain a single post, in some cases, where multiple size twist-on wire connectors are being sold one may wish to have two or more posts on the container to display different size twist-on wire connectors. While the preferred method is to mold the post directly into the container it should be understood that the post may be separately formed and secured to the exterior of the container through adhesives or other types of fastening members.

A disadvantage of placing a product on the exterior of a display container is that a prospective customer may extract the product from the product holder in the container. However, such a disadvantage can become an advantage since the person will be able to more thoroughly realized the benefits of the product and subsequently more likely purchase the products for use if the entire product can be handled.

While an example of the product held and displayed in the product display container is a twist-on wire connector with a soft grip covering that limits hand fatigue, other products may be held and displayed in a touch-and-feel condition. Also, if desired, the product may be displayed and attached to the exterior of the display container through methods other than frictional engagement, for example a fastener, a removable adhesive or the like may be used for the external product holder.

Thus it is envisioned that the invention further includes a method of presenting a container of products for display to a prospective customer with at least one product located in a touch-and-feel position through the steps of forming a container with an internal product compartment formed by a sidewall and a bottom member and forming an external product holder as part of or separate from the sidewall or top of the container; securing a product in the external product holder, for example, by frictionally engaging the product with the external product holder prior to delivering the container to a point of sale; and delivering the container to the point of sale with the product frictionally engaged in the external product holder prior and without disturbing the product frictionally engaged in the external product holder in a touch-and-feel condition.

The above method also includes the ability to stack a plurality of containers without disturbing a product, which may be frictionally engaged in the external product holder of the display container.

We claim:

1. A touch-and-feel product display container comprising;

a container having a sidewall, a top member and a bottom member to form an internal product compartment therein holding a plurality of twist-on wire connectors in a storage condition;

a product comprising a twist-on wire connector; and an external product holder integral to the sidewall for frictionally, retaining the product in a position whereby the product can be seen and touched without removing the product from the external product holder—so as to permit a prospective customer to touch-and-feel the product without having to remove the product from the external product holder wherein the product in the external product holder is identical to the plurality of products in the internal product compartment.

2. The touch-and-feel product display container of claim 1 wherein the external product holder is interior to a plane extending through the sidewall.

3. The touch-and-feel product display container of claim 2 wherein the container includes a removable cover.

4. The touch-and-feel product display container of claim 3 wherein the sidewall is transparent.

5. The touch-and-feel product display container of claim 4 wherein the sidewall extends laterally toward a cover opening in the product display container so that multiple containers can be stacked without interfering with a product displayed in product display holders on each of the multiple containers.

6. The touch-and-feel product display container of claim 5 wherein the external product display holder comprises an extension for frictionally engaging the product.

7. The touch-and-feel product display container of claim 6 where the extension comprise a hollow post for internal frictional engagement with the product.

8. The touch-and-feel product display container of claim 6 wherein the extension comprises a cantilevered post for axially restraining said product located in the external product display and the post is set back from a set of sidewalls so that stacking of identical container do not cause said product to become accidentally dislodged.

9. The touch-and-feel product display container of claim 8 including an integral handle in the sidewall of said container and the top member includes a thread for engagement and disengagement with the removable cover.

* * * * *